US007393253B1

(12) United States Patent
Clifford et al.

(10) Patent No.: US 7,393,253 B1
(45) Date of Patent: Jul. 1, 2008

(54) COOLING SYSTEM FOR A MARINE PROPULSION DEVICE

(75) Inventors: Robert W. Clifford, Stillwater, OK (US); Darrin L. Doty, Stillwater, OK (US); Robert L. Burrell, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 67 days.

(21) Appl. No.: 11/491,464

(22) Filed: Jul. 21, 2006

(51) Int. Cl.
*F01P 3/20* (2006.01)

(52) U.S. Cl. ..... 440/88 C

(58) Field of Classification Search ..... 440/88 R
See application file for complete search history.

(56) References Cited

U.S. PATENT DOCUMENTS 4,258,642 A * 3/1981 Burmeister ..... 440/53
4,371,351 A 2/1983 Tousey ..... 440/88
4,403,972 A 9/1983 Bland et al. ..... 440/88
4,950,190 A * 8/1990 Meisenburg ..... 440/88 M
6,241,566 B1 6/2001 Kermis et al. ..... 440/76
6,663,451 B1 12/2003 Walczak ..... 440/89 R
6,808,432 B1 10/2004 Davis et al. ..... 440/88 C

* cited by examiner

*Primary Examiner*—Jesús D Sotelo
(74) *Attorney, Agent, or Firm*—William D. Lanyi

(57) ABSTRACT

A conduit is configured to facilitate the assembly of a gear case to a driveshaft housing of a sterndrive marine propulsion device while maintaining the proper position of the conduit and assuring proper sealing when the gear case is attached to the driveshaft housing. An alignment protrusion extends from a central portion of the conduit to facilitate the proper positioning of the conduit in relation to the driveshaft housing prior to the attachment of the gear case to the driveshaft housing. A flared portion of a lower end of the conduit is shaped to facilitate the insertion of an outlet of a water pump into the conduit, wherein the water pump is attached to the gear case prior to assembly of the gear case to the driveshaft housing.

16 Claims, 4 Drawing Sheets

COOLING SYSTEM FOR A MARINE PROPULSION DEVICE

BACKGROUND OF THE INVENTION

1. Field of the Invention

The present invention is generally related to a cooling system for a marine propulsion device and, more particularly, to a conduit which is configured to facilitate the assembly of a gear case and driveshaft housing of a sterndrive propulsion system.

2. Description of the Related Art

Those skilled in the art of marine propulsion devices are familiar with sterndrive systems which are attached to the transom of a marine vessel. Water is typically drawn from the body of water in which the marine vessel is operating and conducted, by a pump, through a cooling passage that directs the water through the transom of a marine vessel and to internal cooling passages of a marine engine.

U.S. Pat. No. 4,371,351, which issued to Tousey on Feb. 1, 1983, describes a marine sterndrive cooler. The cooling apparatus for a marine sterndrive unit has a conduit for carrying water from below the water level to a position over the marine sterndrive unit so that water can be sprayed on the sterndrive unit. A water receiving aperture is in communication with a lower portion of the conduit and opens generally horizontally and forwardly for receiving water into the conduit. A water dispensing aperture communicates with an upper portion of the conduit and dispenses the water on the exterior of the marine sterndrive unit thereby cooling a portion of the marine sterndrive unit out of the water.

U.S. Pat. No. 4,403,972, which issued to Bland et al. on Sep. 13, 1983, describes a marine propulsion device including engine housing pump mechanism. A siphon conduit is provided for removing water from the sump, the siphon conduit including an inlet end housed in the sump and a discharge end projecting from the housing for discharging water from the sump. Another conduit is connected to the siphon conduit end for generating water flow through the siphon conduit from the sump and toward the siphon conduit discharge end. The second conduit is connected to the engine water pump and adapted to force a jet of water into the siphon conduit and toward the discharge end of the siphon conduit.

U.S. Pat. No. 6,241,566, which issued to Kermis et al. on Jun. 5, 2001, describes a cooler for a marine sterndrive. The apparatus is of the kind making use of the ram effect and having an intake tube carried on the sterndrive unit with its intake end in the water. The tube has an intake port held below the water surface for accepting water by the ram effect while the boat is moving forward. The water is carried by the tube to a system for delivering water from the intake tube to the sterndrive unit for cooling it.

U.S. Pat. No. 6,663,451, which issued to Walcak on Dec. 16, 2003, discloses a siphon pump for a marine propulsion device. A fluid draining device for an outboard motor is provided with a conduit through which exhaust gases are directed. The flow of exhaust gas through the conduit induces a lowered pressure in a central portion of the structure. The reduced pressure magnitude in the central portion of the structure causes a pressure differential in a drain tube that is sufficient to induce a flow of water through the drain tube from a region to be drained toward the central portion. The device uses the Venturi effect to create the lowered pressure. The exhaust gas flow is directed through the conduit from an idle relief exhaust passage to an exhaust port from which the exhaust exits from the marine propulsion system.

U.S. Pat. No. 6,808,432, which issued to Davis et al. on Oct. 26, 2004, discloses a marine propulsion device with a cooling system cover. The system draws water from a body of water in which a marine vessel is operated and conducts the water through a conduit to an outlet end that is configured to direct a stream of water into a space which is defined under a removably attachable cover and above a surface of a heat producing portion of the outdrive. The cover contains a turbulently flowing stream of water in the space in order to more efficiently conduct the water in thermal communication with the outer surface of the heat producing portion. Return passages are provided between the cover and the surface of the outdrive to allow water to return, under the influence of gravity, back to the body of water from which it was drawn.

The patents described above are hereby expressly incorporated by reference in the description of the present invention.

The patents described above involve the conduction of water within the structure of a marine propulsion device. In certain marine propulsion devices, it is necessary to provide a fluid conduit between two portions of the marine propulsion device. When the two portions are assembled together, it is sometimes difficult to properly position the water conducting device in its proper position while maintaining an appropriate seal to prevent leakage of water being conducted through the device. This is particularly troublesome when the assembly requires that the portions of the marine propulsion device be attached together without allowing continued access to, or visibility of, the fluid conductor during the assembly process. It would therefore be significantly beneficial if a water conducting tube or hose could be provided that facilitates the assembly process while maintaining the integrity of the seals used to contain water within the fluid conducting device.

SUMMARY OF THE INVENTION

A cooling system for a marine propulsion device made in accordance with a preferred embodiment of the present invention comprises a driveshaft housing having a water passage contained therein, a gear case, a water pump attached to the gear case, a conduit having a first end and a second end, a stiffener disposed around a portion of the second end, and an alignment protrusion formed as an integral portion of the conduit. The first end of the conduit is configured to be connected to the water passage of the driveshaft housing and the second end is configured to be attached to the water pump. The conduit has a central portion attached between the first and second ends and the second end has a distal edge which is flared outwardly from a tubular diameter of the second end. The stiffener is configured to limit expansion of the second end in a radially outward direction. The alignment protrusion is formed as an integral portion of the conduit and extends from the conduit at a location between the first and second ends. The alignment protrusion is shaped to be moved into contact with a portion of the driveshaft housing.

In a particularly preferred embodiment of the present invention, the conduit is made of an elastomeric material, such as rubber, and the stiffener is a plastic ring, or hoop, disposed around a portion of the second end. The gear case is attached to the driveshaft housing and the water pump is attached to the gear case. The conduit is connected in fluid communication between the water passage and the gear case. The first end of the conduit is generally symmetrical about a first axis and the second end is generally symmetrical about a second axis. The first and second axes are offset from each other.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
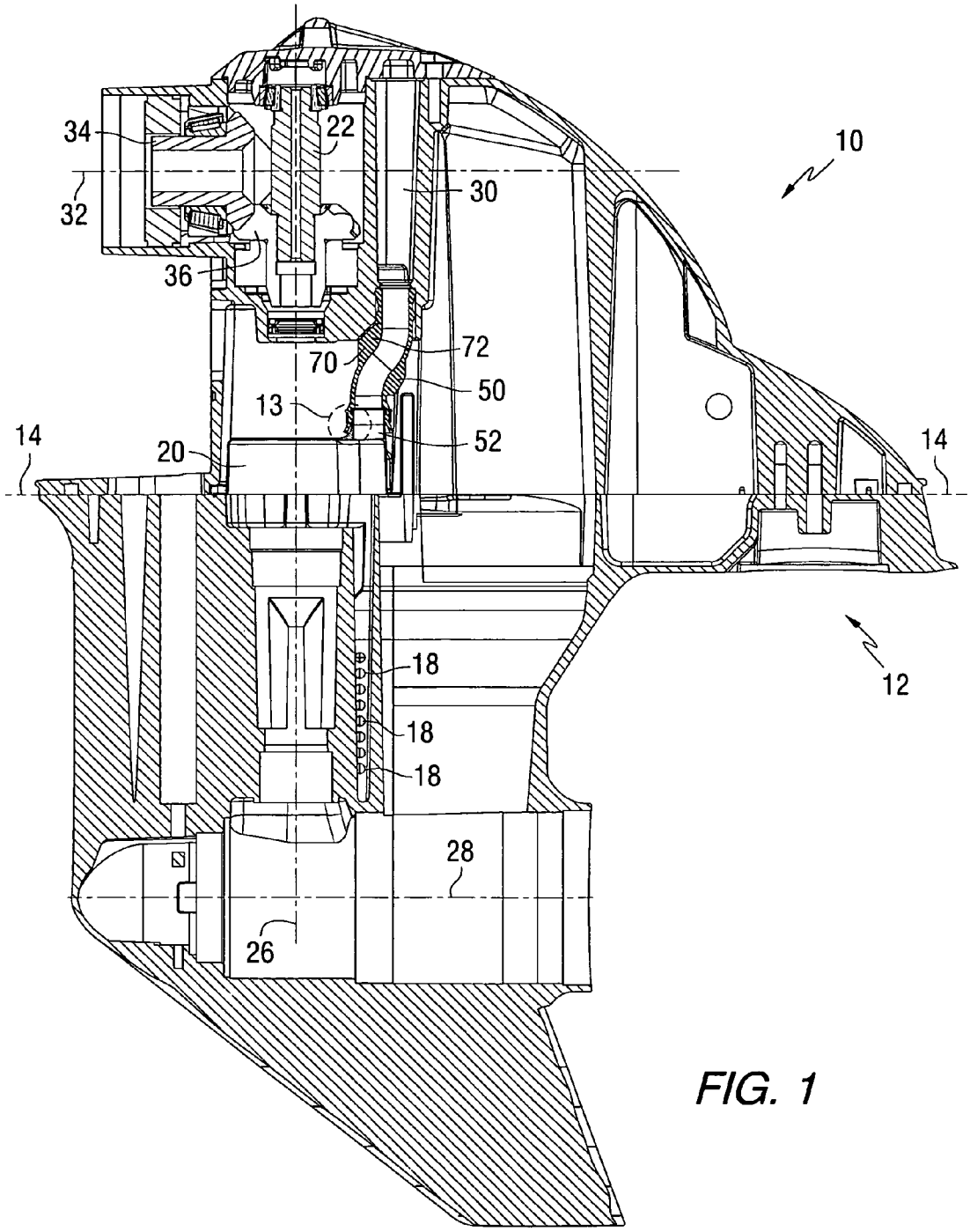
FIG. 1 is a side section view of a marine propulsion device comprising a driveshaft housing and a gear case.

Throughout the description of the preferred embodiment of the present invention, like components will be identified by like reference numerals.

FIG. 1 is a side section view, from the port side of a marine propulsion device, showing the driveshaft housing 10 and the gear case 12. Dashed line 14 identifies the location of the mating surfaces of the driveshaft housing 10 and gear case 12. Water is drawn through a plurality of holes 18 and directed upwardly to a water pump 20 which is attached to the gear case 12. The water pump 20 is driven by its association with a driveshaft 22 which is rotatable about axis 26. Although not shown in FIG. 1, a propeller shaft is supported by the gear case 12 for rotation about axis 28 and is connectable in torque transmitting relation with the driveshaft 22.

The water drawn upwardly by the pump 20 is directed toward a water passage 30 for eventual conduction through a transom of a marine vessel in a manner that is generally known to those skilled in the art. A driveshaft which extends through the transom of the marine vessel (not shown in FIG. 1) is rotatable about axis 32 and drives bevel gear 34 which is connected in torque transmitting relation with bevel gear 36. Bevel gear 36 is attached to the driveshaft 22. Proper connection must be maintained between the water passage 30 and the water pump 20 when the gear case 12 is assembled to the driveshaft housing 10. This function is accomplished by a conduit 50 which will be described in greater detail below.

Figure 2:
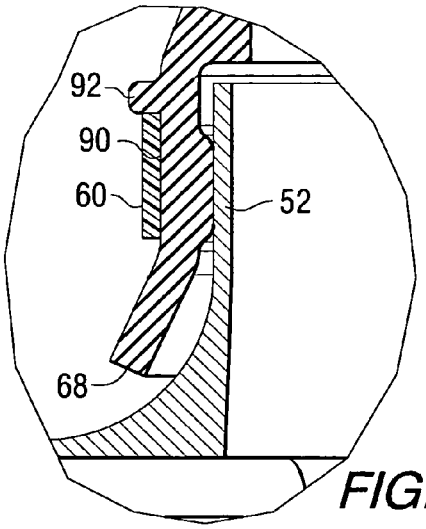
FIG. 2 is an enlarged partial view of a portion of the device illustrated in FIG. 1.

FIG. 2 is an enlarged illustration of the region (reference numeral 13 in FIG. 1) where the conduit 50 attaches to the outlet 52 of the water pump 20. In FIG. 2, the bottom of the conduit 50 is shown in relation to the outlet tube 52 of the water pump and a stiffener 60 which will be described in greater detail below.

Figure 3:
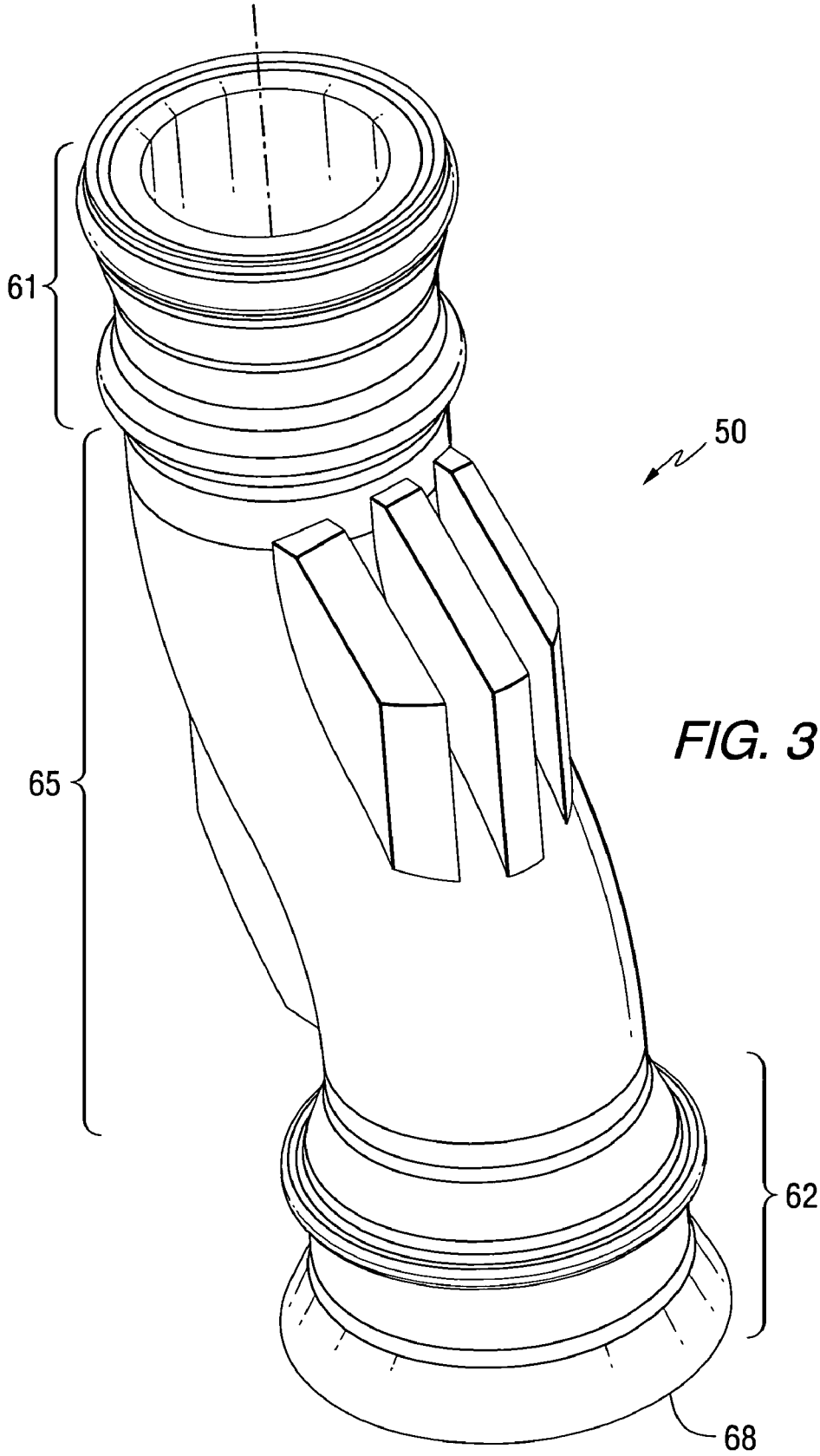
FIG. 3 is an isometric view of a conduit of the present invention.

FIG. 3 is an isometric view of the conduit 50 which has a first end 61 and a second end 62. The first end 61 is configured to be connected to the water passage 30 described above in conjunction with FIG. 1. The second end 62 is configured to be attached to the outlet 52 of the water pump 20. The conduit 50 has central portion 65 which is attached between the first and second ends, 61 and 62. The second end 62 has a distal edge 68 that is flared outwardly from a tubular diameter of the second end 62.

Figure 4:
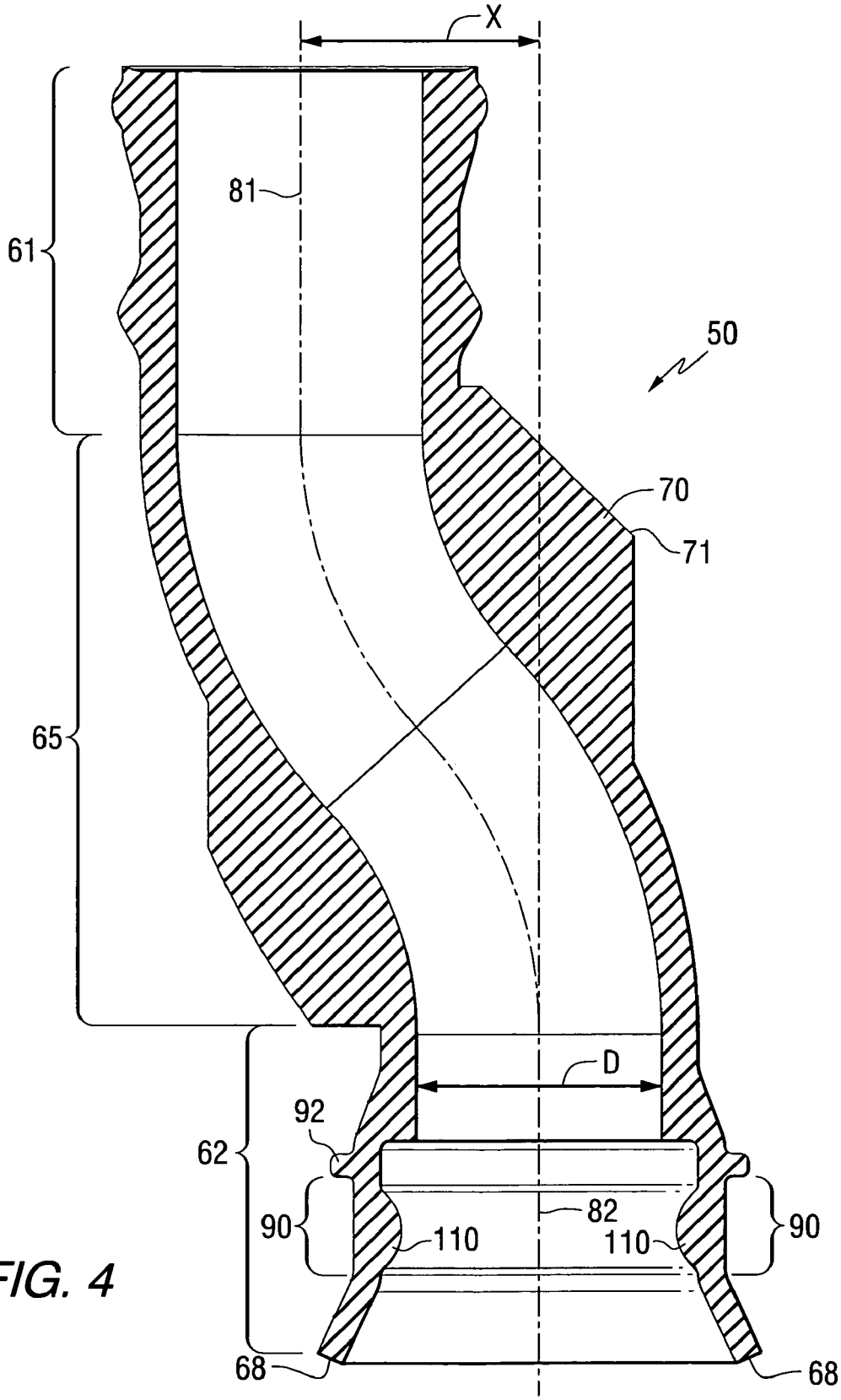
FIG. 4 is a section view of the conduit of the present invention.

FIG. 4 is a section view of the conduit 50. In a preferred embodiment of the present invention, the conduit 50 is made of an elastomeric material, such as rubber. The stiffener 60, described above in conjunction with FIG. 2, is preferably a plastic ring which is disposed around a portion of the second end 62. In a preferred embodiment of the present invention, the conduit 50 further comprises an alignment protrusion 70 which is formed as an integral portion of the conduit 50 and extends from the conduit at a location between the first and second ends, 61 and 62. The alignment protrusion is shaped to be moved into contact with a portion of the driveshaft housing. This contact is illustrated in FIG. 1 where the alignment protrusion 70 is placed in contact with a surface 72 of the driveshaft housing 10 near the inlet of the water passage 30.

With continued reference to FIG. 4, the first end 61 is generally symmetrical about a first axis 81 and the second end 62 is generally symmetrical about a second axis 82. The first and second axes are offset from each other, as identified by arrow X in FIG. 4. This offset accommodates the double bend in the central portion 65 of the conduit 50.

With continued reference to FIG. 4, it can be seen that the second end 62 has a distal edge 68 that is flared outwardly from the tubular diameter D of the second end 62. Stated alternatively, the distal edge 68 of the second end 62 is formed in the shape of a frustum of a cone. An outer surface of the second end 62 is identified by reference numeral 90 in FIG. 4. This outer surface is generally cylindrical and is shaped to accommodate the stiffener 60 which, in a preferred embodiment of the present invention, is circular and generally hoop-shaped. This relationship is shown in FIG. 2.

Figure 5:
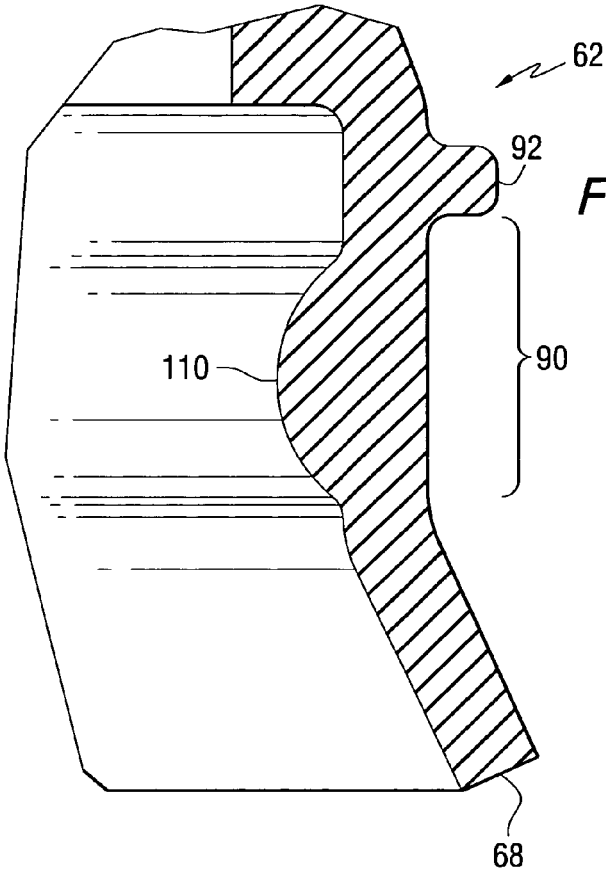
FIG. 5 is a section view of the portion of the lower end of the conduit of the present invention.

FIG. 5 is a partial section view of the lower portion of the second end 62 of the conduit 50. The flared distal edge 68 is shown extending, in the shape of a frustum of a cone, from the region where the outer cylindrical surface 90 of the second end 62 is located. Directly above this cylindrical surface 90 is a small protrusion 92 which facilitates the positioning of the stiffener 60 between it and the outwardly tapered distal edge 68.

Figure 6:
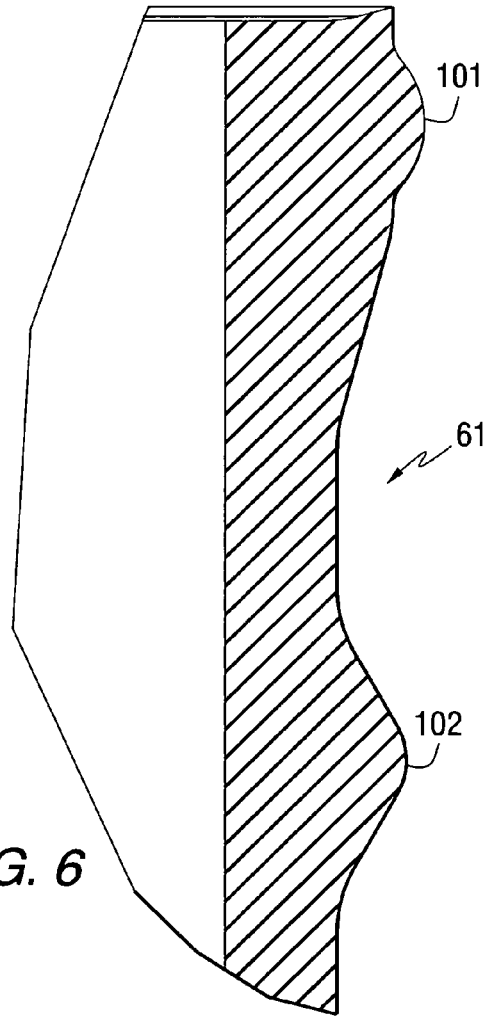
FIG. 6 is a section view of a portion of the upper end of the conduit of the present invention.

FIG. 6 is a section view of a portion of the first end 61 of the conduit 50. Two outwardly projecting ridges, 101 and 102, are provided to facilitate the positioning and maintenance of the first end 61 in the inlet of the water passage 30 described above in conjunction with FIG. 1.

With reference to FIGS. 1-6, the assembly procedure will be described. The water pump 20 is initially attached to the gear case 12 while it is separated from the driveshaft housing 10. With respect to the driveshaft housing 10, the conduit 50 is inserted into the inlet of the water passage 30. The first and second ridges, 101 and 102, are sized to be in slight interference with the inside diameter of the inlet of the water passage 30 so that they perform the function of holding the conduit 50 in the inlet of the water passage. In addition, a sealing lubricant having a paste-like consistency can be disposed on the outer surface of the first end 61 between the first and second ridges, 101 and 102, to assist in maintaining the first end 61 in position within the inlet of the water passage 30. The interference fit and the paste-like lubricant are generally sufficient to overcome the weight of the conduit 50 and hold it in place. The surface 71 of the alignment protrusion 70, described above in conjunction with FIG. 4, facilitates the proper positioning of the conduit 50 with respect to the surface 72 of the driveshaft housing 10. This properly aligns the conduit 50 with respect to the driveshaft housing 10 and properly locates the second axis 82 with respect to the location of the outlet 52 of the pump 20 when the gear case 12 is moved upwardly and into contact with the driveshaft housing 10 along contact surface 14. During this assembly, the flared portion of the second end 62 facilitates the insertion of the outlet 52 into the second end of the conduit 50. The internal ridge 110 of the second end 62 is sized to create a slight interference fit with the outside cylindrical surface of the outlet 52. The material of the conduit 50 is rubber and is generally flexible. This allows the second end 62 to expand slightly to accommodate the insertion of the outlet 52 along the central axis 82. The position of the stiffener 60 limits this expansion and provides an improved compression force exerted by the ridge 110 of the second end 62 against the outer surface of the outlet 52.

The stiffener 60, which is a plastic hoop-shaped structure in a preferred embodiment of the present invention, limits the expansion of the elastomeric material of the second end 62 when internal pressure is created within the conduit 50 as a result of the operation of the water pump 20. This pressure tends to expand the second end 62 in a radially outward direction away from the second axis 82. The stiffener 60, described above in conjunction with FIG. 2, limits this expansion and maintains the compression on the ridge 110 to maintain a seal on this region.

With continued reference to FIGS. 1-6, it can be seen that a preferred embodiment of the present invention provides a cooling system for a marine propulsion device that comprises a driveshaft housing 10 having a water passage 30 contained therein, a gear case 12, a water pump 20 attached to the gear case 12, a conduit 50 having a first end 61 and a second end 62, a stiffener 60 disposed around a portion 90 of the second end 62, and an alignment protrusion 70 formed as an integral part of the conduit 50 and extending from the conduit 50 at a location between the first and second ends, 61 and 62. The first end 61 is configured to be connected to the water passage 30 of the driveshaft housing 10 of the marine propulsion device. The second end 62 is configured to be connected to an outlet 52 of the water pump 20. The conduit 50 has a central portion 65 between the first and second ends, 61 and 62. The second end 62 has a distal edge 68 which is flared outwardly from a tubular diameter D of the second end 62. The stiffener 60 is configured to limit expansion of the second end 62 in a radially outward direction. The alignment protrusion 70 is shaped to be moved into contact with a portion 72 of the driveshaft housing 10. The conduit 50 in a preferred embodiment of the present invention is made of an elastomeric material such as rubber. The stiffener 60 is a plastic ring disposed around a portion 90 of the second end 62. The gear case 12 is attached to the driveshaft housing 10 and the water pump 20 is attached to the gear case 12. The conduit 50 is connected in fluid communication between the water passage 30 and the gear case 12. The first end 61 is generally symmetrical about a first axis 81 and the second end 62 is generally symmetrical about a second axis 82. The first and second axes, 81 and 82, are offset from each other by a distance identified as X in FIG. 4.

Although the present invention has been described with particular specificity and illustrated to show a preferred embodiment, it should be understood that alternative embodiments are also within its scope.

We claim:

1. A cooling system for a marine propulsion device, comprising:

a conduit having a first end and a second end, said first end being configured to be connected to a water passage of a driveshaft housing of said marine propulsion device, said second end being configured to be connected to a water pump;

a stiffener disposed at said second end, said stiffener being configured to limit expansion of said second end in a radially outward direction; and an alignment protrusion formed as an integral portion of said conduit and extending from said conduit at a location between said first and second ends.

2. The cooling system of claim 1, wherein:

a distal edge of said second end of said conduit is formed in the shape of a frustum of a cone.

3. The cooling system of claim 1, wherein:

said alignment protrusion is shaped to be moved into contact with a portion of said driveshaft housing.

4. The cooling system of claim 1, wherein:

said conduit is made of rubber.

5. The cooling system of claim 1, wherein:

said stiffener is a ring disposed around a portion of said second end.

6. The cooling system of claim 1, further comprising:

a gear case attached to said driveshaft housing, said water pump being attached to said gear case, said conduit being connected between said gear case and said driveshaft housing and in fluid communication between said water passage and said gear case.

7. A cooling system for a marine propulsion device, comprising:

a conduit having a first end and a second end, said first end being configured to be connected to a water passage of a driveshaft housing of said marine propulsion device, said second end being configured to be connected to a water pump, said conduit having a central portion attached between said first and second ends, said second end having a distal edge which is flared outwardly from a tubular diameter of said second end;

a stiffener disposed at said second end, said stiffener being configured to limit expansion of said second end in a radially outward direction; and an alignment protrusion formed as an integral portion of said conduit and extending from said conduit at a location between said first and second ends said alignment protrusion being shaped to be moved into contact with a portion of said driveshaft housing.

8. The cooling system of claim 7, wherein:

said conduit is made of an elastomeric material.

9. The cooling system of claim 8, wherein:

said stiffener is a ring disposed around a portion of said second end.

10. The cooling system of claim 9, wherein:

said ring is made of plastic.

11. The cooling system of claim 9, further comprising:

a gear case attached to said driveshaft housing, said water pump being attached to said gear case, said conduit being connected between said gear case and said driveshaft housing and in fluid communication between said water passage and said gear case.

12. The cooling system of claim 7, wherein:

said first end is generally symmetrical about a first axis and said second end is generally symmetrical about a second axis, said first and second axes being offset from each other.

13. A cooling system for a marine propulsion device, comprising:

a drive shaft housing having a water passage contained therein;

a gear case;

a water pump attached to said gear case;

a conduit having a first end and a second end, said first end being configured to be connected to said water passage of said driveshaft housing of said marine propulsion device, said second end being configured to be connected to said water pump, said conduit having a central portion attached between said first and second ends, said second end having a distal edge which is flared outwardly from a tubular diameter of said second end;

a stiffener disposed around a portion of said second end, said stiffener being configured to limit expansion of said second end in a radially outward direction, said stiffener being a plastic ring disposed around a portion of said second end; and an alignment protrusion formed as an integral portion of said conduit and extending from said conduit at a location between said first and second ends, said alignment protrusion being shaped to be moved into contact with a portion of said driveshaft housing.

14. The cooling system of claim 13, wherein:

said conduit is made of an elastomeric material.

15. The cooling system of claim 13, wherein:

said gear case is attached to said driveshaft housing, said water pump being attached to said gear case, said conduit being connected in fluid communication between said water passage and said gear case.

16. The cooling system of claim 13, wherein:

said first end is generally symmetrical about a first axis and said second end is generally symmetrical about a second axis, said first and second axes being offset from each other.

* * * * *